United States Patent [19]

Lovich et al.

[11] 3,972,437

[45] Aug. 3, 1976

[54] CARGO CONTAINER

[75] Inventors: John W. Lovich; Oscar W. Meller; Frank C. Morse, all of Akron, Ohio

[73] Assignee: Goodyear Aerospace Corporation, Akron, Ohio

[22] Filed: Jan. 10, 1975

[21] Appl. No.: 540,054

[52] U.S. Cl. ..... 220/1.5; 220/4 R

[51] Int. Cl.[2] ..... B65D 7/00; B65J 1/02

[58] Field of Search ..... 220/1.5, 4 R, 4 F; 217/12 R, 13; 292/39

[56] References Cited

UNITED STATES PATENTS

| | | | |
|---|---|---|---|
| 1,996,865 | 4/1935 | Haag | 292/39 |
| 3,040,925 | 6/1962 | Mills | 220/1.5 |
| 3,853,238 | 12/1974 | Luisada | 220/1.5 |

*Primary Examiner*—William Price
*Assistant Examiner*—Steven M. Pollard
*Attorney, Agent, or Firm*—Oldham & Oldham Co.

[57] ABSTRACT

Disclosed is a cargo container of basically cubicle construction having a single door providing access thereinto and being secured to the container framework by means of a threeway latch assembly. Tie down fittings are provided about the lower portion of the interior of the container for securing cargo therein. There is further provided at the top four corners of the container hoist brackets providing means for lifting and maneuvering the container.

6 Claims, 6 Drawing Figures

CARGO CONTAINER

BACKGROUND OF THE INVENTION

It has been known for many years that the efficient, safe and economical handling of cargo in a mass transit system is most readily accomplished by the utilization of cargo containers. Of necessity, such cargo containers must be lightweight and yet sturdy in construction while providing maximum usable storage space within the confines of the structure. It is further required that the securing and access to the interior of the cargo container be easily achieved. It is further most desirable that means be provided for sliding, hoisting, or otherwise moving the container without adversely affecting the structural integrity thereof.

Consequently, it is an object of the instant invention to present a cargo container having the structural attributes presented hereinabove and which is inexpensive to construct, easy to maintain, and capable of withstanding the rigors and abuses incident to the handling of bulk cargo.

These objects and other objects which will become apparent as the detailed description proceeds are achieved by a cargo container having a basically cubical framework, comprising a top interconnected with end panels and a back panel, a base substantially parallel to the top and interconnected with the end panels and back panel; a door hingedly connected on one side thereof to the framework; and latching means extending along the opposite side of the door and operative for making simultaneous latching engagement with the framework at a plurality of points.

For a complete understanding of the objects and structure of the invention reference should be had to the following detailed description and accompanying drawings wherein.

Figure 1:
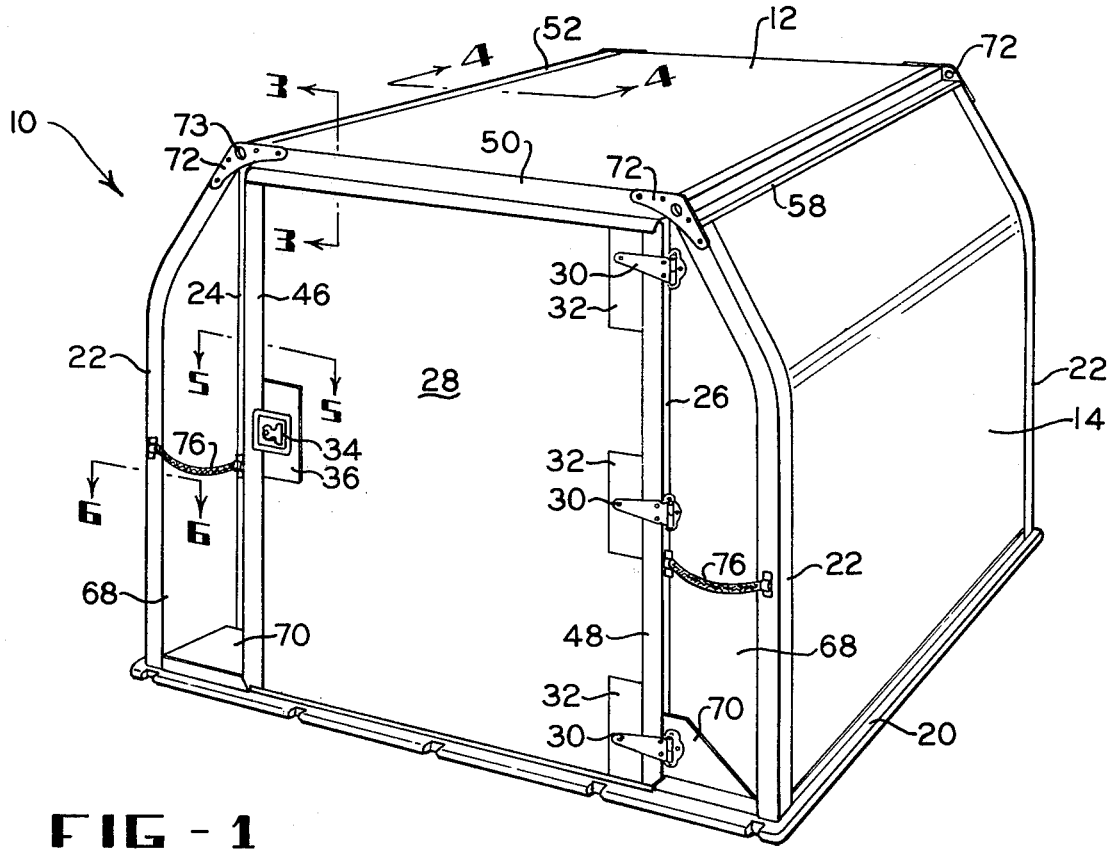
FIG. 1 is a perspective view of the cargo container of the invention having the door thereof in a closed position.
Figure 3:
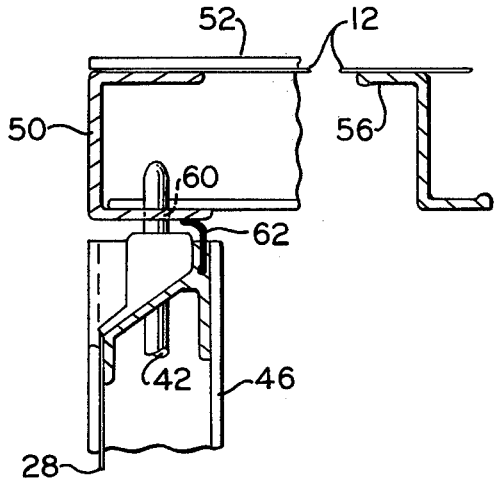
FIG. 3 is a sectional view of the engagement between the door and the roof of the container taken along the line 3—3 of FIG. 1.

Referring now to the drawings and more particularly FIG. 1, it can be seen that the cargo container of the invention is designated generally by the numeral 10. The container 10 fundamentally comprises a top 12 interconnected with end panels 14 and 16 and a base 18. Further interconnecting the aforementioned elements is a back panel 17. The elements 12–17 are all preferably of reinforced aluminum sheet construction as will be discussed hereinafter. The base 18 is most preferably of an aluminum clad balsa wood construction which provides for lightweight strength. The base 18 is encompassed by extruded edge members 20 which are functional for providing securing means to the vertically extending elements of the container and for covering the edges of the aluminum clad balsa sandwich material.

Figure 4:
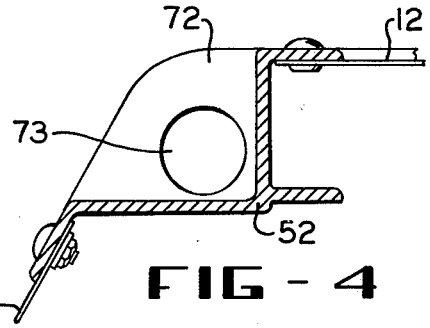
FIG. 4 is a sectional view of the interconnection between the roof and end panel of the cargo container as taken along the lines 4—4 of FIG. 1.
Figure 2:
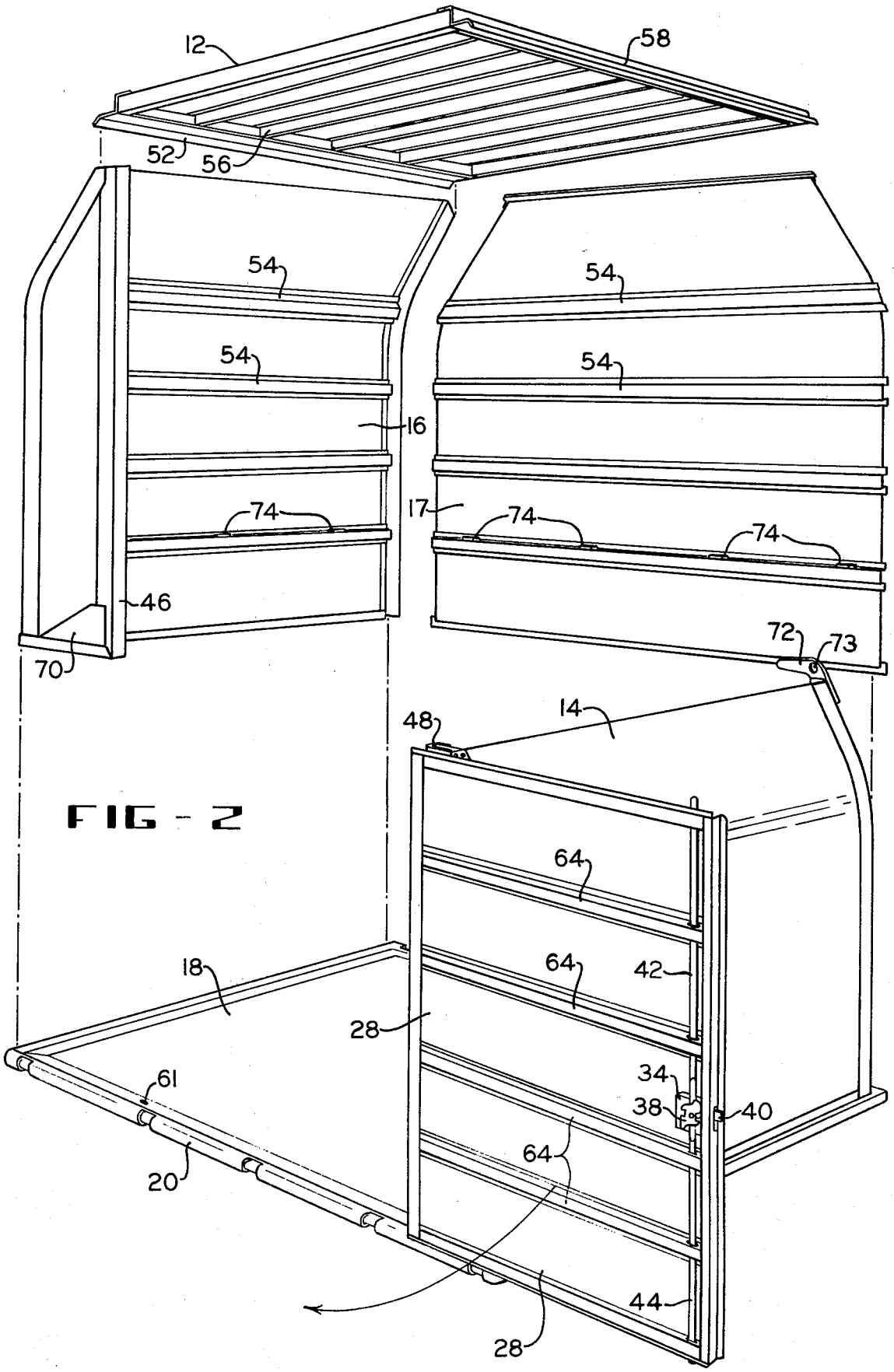
FIG. 2 is an assembly-type drawing of the basic structural element of the invention wherein the door thereof is opened.

Vertically extending angle elements 22 provide corner posts for the cargo container which are angled inwardly toward the top thereof. Channel posts 24 and 26 extend upwardly from the base of the container and make securing engagement with the angle elements 22 to provide a door jamb for the door 28. The door 28 is again of a preferably sheet construction reinforced by means of channel stringers 64 as best shown in FIG. 2. The door 28 is fixedly secured to the container by means of a plurality of hinges 30 secured to the channel by means of a plurality of hinges 30 secured to the channel post 26 and the door 28. Reinforcement plates 32 are provided on the door 28 at the point of connection with the hinges 30. A three way latch assembly 34 is provided on the door 28 adjacent the post 24. The door 28 is reinforced about the latch assembly 34 by means of the reinforcement plate 36. As can best be seen in FIG. 2, the assembly 34 utilizes a cam 38 which is operative to actuate the bolt 40 and upper and lower rods 42,44 to simultaneously engage and disengage the same with mating locking slots. The bolt 40 and upper and lower rods 42,44 are operative within the door edge channel member 46 to make engagement with a hole 60 provided within the header 50 of the container and a corresponding hole 61 within the extruded edge member 20. Further engagement is made between the bolt 40 and the hole 41 provided within the channel post 24 comprising a portion of the door jamb. On the hinged side of the door there is provided a door edge channel member 48 similar in nature to the element 46 and providing for the door 28 a degree of vertical rigidity. As can best be seen in FIGS. 2 and 4, roof beams 52 and 58 are of a dog-leg nature and are provided for interconnecting the roof sheet 12 to the respective end panels 14 and 16. Reinforcement stringers or Z-stiffners 56 pass between the roof beams 52,58 to add strength and rigidity to the roof sheet 12.

A plurality of channel members 54 are provided along the back panel 17 and end panels 14,16 to reinforce the same while retaining the lightweight structure.

Figure 5:
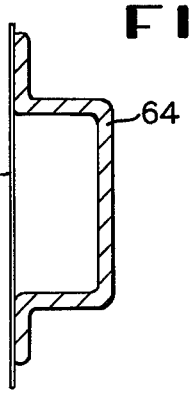
FIG. 5 is a sectional view of the latching engagement between the door jamb and door assembly as taken along the line 5—5 of FIG. 1.
Figure 5:
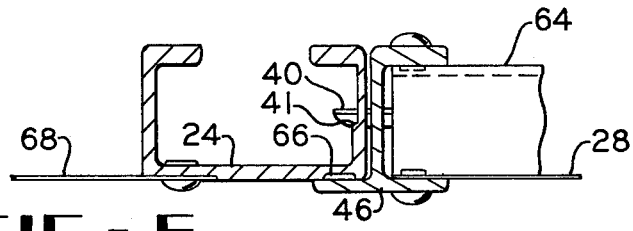

Sealing of the door of the container with the framework thereof is achieved along the top and bottom by means of rubber seals 62 presented within an extruded groove along the entire upper and lower widths of the door. The flexible seals 62 are operative for making sealing engagement with the header 50 and the extruded edge member 20 to achieve the desired purpose. A labyrinth groove 66 is provided in both of the vertical door jambs 24,26 as shown in FIG. 5. Locking engagement of the bolt 40 with the hole 41 within the channel member 24 brings the door edge channel member 46 into tight sealing engagement with the groove 66 and similarly forces a similar engagement between the edge member 48 and the channel 26.

As can further be seen from the drawing, trapezoidal end panels 68 are provided to complete the front closure of the container along each side of the door 18. Brackets 70 reinforce the trapezoidal panel and provide for secure engagement between the vertical channels 24,26 and the base of the container. Also provided between the angled element posts 22 and the channel members 24,26 are straps 76 for purposes of facilitating handling of the container 10. Further, for aiding in maneuvering of the container, there are steel hoist fittings or brackets 72 provided at each of the upper corners of the container and having holes 73 therein for receiving hoist hooks or the like.

As an added feature for providing for securing engagement of the cargo container within the structure 10, there is provided a plurality of tie down fittings 74 about the lower channel member 54 of the back and end panels of the container. In normal fashion, ropes or other securing means may be interengaged among the various tie down fittings 74 to hold cargo in a secure manner.

Figure 6:
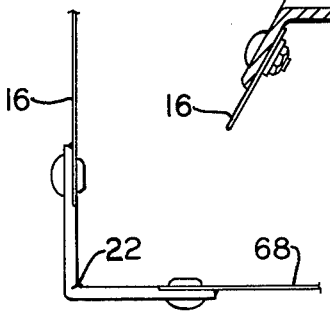
FIG. 6 is a sectional view of the interconnection between the end panels and front trapezoidal panels of the invention as taken along the line 6—6 of FIG. 1.

As can best be seen in FIG. 6, final interconnection of all the elements of the container not heretofore described is achieved by the vertical angle elements 22 interconnecting, for example, the trapezoidal panel 68 and end panel 16 as shown.

Thus it can be seen that the objects of the invention have been satisfied by the structure presented and described hereinabove. While in accordance with the patent statutes only the best mode and preferred embodiment of the invention has been presented and described in detail, it is to be understood that the invention is not limited thereto or thereby. Consequently, for an appreciation of the scope and breadth of the invention reference should be had to the following claims.

What is claimed is:

1. A cargo container having a basically cubicle framework, comprising:

a top interconnected with end panels and a back panel;

a base substantially parallel to the top and interconnected with the end panels and back panel;

a door hingedly connected on one side thereof to the framework;

latching means extending along the opposite side of the door and operative for making simultaneous latching engagement with the framework at a plurality of points; and wherein the top and end panels are interconnected by doglegged roof beams, said beams being capped at each end thereof with hoist brackets, each such bracket having a receptacle therein for making engagement with a lifting device.

2. The cargo container as recited in claim 1 wherein said latching means includes upper and lower vertically moving rods and a horizontally moving bolt, the upper and lower rods respectively making engagement with a header and a base edge member and the bolt making engagement with a vertical door post.

3. The cargo container as recited in claim 1 wherein said hoist brackets comprise annular plates.

4. The cargo container as recited in claim 1 wherein a back panel interconnects said top and end panels, the top, back and end panels being of aluminum sheet construction and being reinforced with a plurality of beams and channel members traversing the respective elements.

5. The cargo container as recited in claim 4 which further includes a plurality of tie down fittings affixed to certain of the channel members about the back and end panels for receiving cargo securing means thereamong.

6. The cargo container as recited in claim 1 wherein said opposite side of the door has affixed thereto a door edge channel member making sealing engagement with a channel door post having a verticle labyrinth groove extending the entire length thereof.

* * * * *